United States Patent [19]

Möltner et al.

[11] Patent Number: 4,718,280

[45] Date of Patent: Jan. 12, 1988

[54] ROLLING LINE WITH MEASURING MEANS

[75] Inventors: Herrmann Möltner, Grevenbroich; Hans-Dieter Gerhards, Monheim, both of Fed. Rep. of Germany

[73] Assignee: Kocks Technik GmbH & Co., Hilden, Fed. Rep. of Germany

[21] Appl. No.: 900,753

[22] Filed: Aug. 27, 1986

[30] Foreign Application Priority Data

Sep. 17, 1985 [DE] Fed. Rep. of Germany ..... 3533120

[51] Int. Cl.[4] ..... G01B 5/30

[52] U.S. Cl. ..... 73/760

[58] Field of Search ..... 72/235, 234, 226, 237; 73/760

[56] References Cited

U.S. PATENT DOCUMENTS 3,221,529 12/1965 Chang ..... 72/237 X 4,002,048 1/1977 Pozsgay ..... 72/234 X

*Primary Examiner*—Jerry W. Myracle

*Attorney, Agent, or Firm*—Buell, Ziesenheim, Beck & Alstadt

[57] ABSTRACT

A rolling line for rolling tubular or rod-shaped material, in particular of reducing tubes, has a plurality of rolling stands disposed closely one after the other, as well as measuring rolls disposed upstream of and/or beyond the rolling stands and rolling on the material. In order to keep the distance between the measuring rolls and the first or last rolling stands as small as possible whatever the number of rolling stands used, and hence to ensure the longest possible use of the measuring rolls, said measuring rolls are disposed in measuring roll stands which fit into the reception pockets of the rolling stands which, like said rolling stands, can be displaced and disposed in or against the direction of rolling.

3 Claims, 5 Drawing Figures

ROLLING LINE WITH MEASURING MEANS

The invention relates to a rolling line for rolling tubular or rod-shaped material, having a plurality of rolling stands exchangeable clamped in reception pockets of a base frame closely one after the other as well as measuring rolls disposed upstream of the rolling stands at the entry end and/or beyond the rolling stands at the delivery end and rolling on the material.

A known rolling line of this type (German Patent Specification No. 29 47 233) is used to stretch-reduce tubes and has a device for controlling the wall thickness of these tubes. In order to be able to control the wall thickness, the actual elongation of the rolling line should be continuously detected by measuring the run-through speed of the material upstream of the first rolling stand at the entry end and beyond the last rolling stand at the delivery end. The actual elongation is the quotient of the delivery speed and the entry speed. These speeeds are measured by measuring rolls which roll on the surface of the material. The measuring rolls actuate a pulse generator whose pulses can be used as measured values for the speed in each case. Such measuring rolls are fixedly disposed in the known design upstream of the first reception pocket on the entry end and beyond the last reception pocket on the delivery end. The distance between these measuring rolls is known and is maintained throughout each operating condition of the rolling line.

In this type of rolling line, it is often not necessary to equip all the available reception pockets with a rolling stand. Frequently only a part of the maximum number of useable rolling stands is required to achieve the desired reduction in the material cross section. This is generally the case when the same starting material is to be used to produce material with a relatively large cross-sectional area. This produces shorter lengths of the material. This can, however, also be conditioned by correspondingly short lengths of the starting material. In the case of short material lengths, the time in which both measuring rolls are simultaneoulsly rolling on the material and accurate measurement and control is possible is relatively short. On the other hand, the period in which either only the measuring roll at the entry end or the measuring roll on the delivery end is working, either because the beginning of the material has not yet reached the measuring roll on the delivery end or because the end of the material has already passed the measuring roll at the entry end, is long. If only one of the two measuring rolls is working, the actual elongation at this moment in the known rolling line can no longer be ascertained, so that the total elongation, and hence the cross-sectional area, in particular the thickness of the material wall, cannot be optimally controlled, as is mentioned in German Patent Specification No. 29 47 233. If only a few rolling stands are required, the distance between the first rolling stand and the fixed measuring roll disposed upstream or the last rolling stand and the fixed measuring roll disposed downstream is unnecessarily large, and thus considerably increases the ineffectiveness of the measuring rolls.

It is an object of the invention to keep the period in which both measuring rolls are working as long as possible.

The invention resides in a rolling line for rolling tubular or rod-shaped material, having a plurality of rolling stands exchangeably clamped in reception pockets of a base frame closely one after the other, and having a measuring means disposed upstream of the rolling stands at the entry end and beyond the rolling stands at the delivery end and measuring a dimension or other characteristic of the material, each measuring means being supported in or on a measuring roll stand which has the same support and reception surfaces as the rolling stands and which can, like the rolling stands, be inserted and clamped in any reception pocket.

This allows the distance between the measuring roll at the entry end and the measuring roll at the delivery end, and hence the down times of either one of the two measuring rolls, to be considerably reduced if not all the available reception pockets are equipped with rolling stands, as is usually the case. If, for example, only the first ten reception pockets of a rolling line having, for example, twenty-eight reception pockets are equipped with rolling stands, the measuring roll at the delivery end, and hence the entire control device in the known construction, would not begin to work, on entry of the material, until the leading end of the material being rolled had passed the remaining eighteen reception pockets beyond the last rolling stand. In the rolling line according to the present example of the invention, this occurs immediately upon leaving the tenth rolling stand, because the measuring roll and its measuring roll stand can be put into the first free reception pocket, that is, the eleventh reception pocket, directly following the last rolling stand. The same applies analogously to all the other rolling stand arrangements, so that the development according to the invention always enables the distance between the measuring rolls and the first or last rolling stand to be kept as small as possible, completely independently of the number of rolling stands and of the reception pockets in which they are inserted. The short distance between the measuring rolls and the nearest rolling stand guaranteed in this manner keeps the period in which both measuring rolls cannot work to an optimally short length. Thus the period in which optimum measurement and control is possible is considerably increased. As the measuring roll stands have the same support and reception surfaces as the rolling stands, they can readily be moved by the existing exchanging devices for the rolling stands, so that, in the event of a change in the rolling program, the rolling line and measuring rolls are ready for operation again in a very short time.

It is recommended to provide an additional reception pocket for the measuring roll stands only either upstream of the first reception pocket at the entry end or beyond the last reception pocket at the delivery end for the rolling stands. In this embodiment of the invention, none of the reception pockets provided with drive shafts for the rolling stands has to be occupied by measuring roll stands, so that the rolling line can be provided with the maximum number of rolling stands. At the same time, it is usually possible to equip existing rolling lines with additional reception pockets at the entry or delivery end, so that the invention can also be used in rolling lines of older designs.

The invention is further described, by way of example, with reference to the accompanying drawings, in which.

Figure 1:
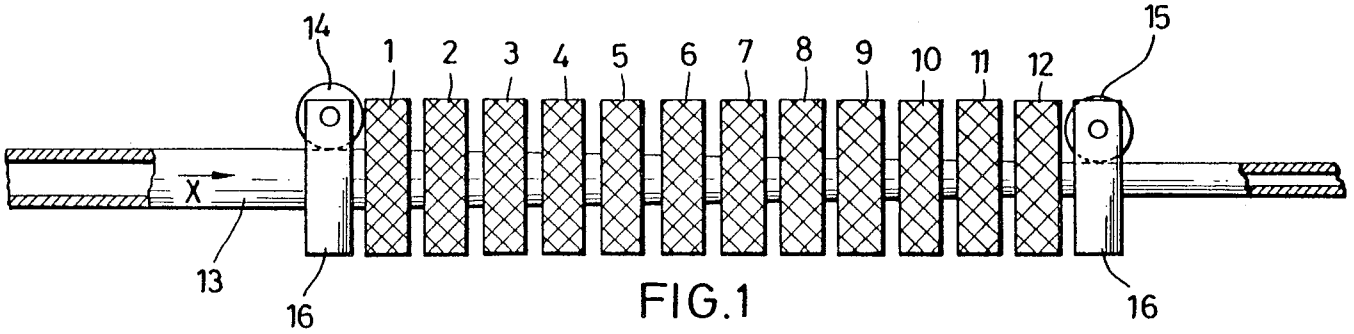
FIG. 1 is a schematic representation of a rolling line having measuring roll stands.

FIG. 1 shows a number of rolling stands 1 to 12 which are exchangeably clamped in reception pockets of a base frame (not shown) closely one after the other. This rolling line is a stretch-reducing rolling line for tubes, whose drive and other details are known and do not need to be shown or described. The drive has the same number of output shafts as there are pockets for the maximum number of rolling stands, and the input shafts of the latter are releasably coupled to the drive output shafts. The tube 13 to be reduced runs through the rolling stands 1 to 12 in the direction of the arrow X and it can clearly be seen that, in doing so, both the outer diameter and the wall thickness are reduced.

For a variety of reasons, in this case, for example, to establish the actual elongation of this rolling line, two measuring rolls 14 and 15 are required which are disposed at the entry end upstream of the first rolling stand 1 and at the delivery end beyond the last rolling stand 12. In other rolling lines, photoelectric cells, wall thickness measuring devices or other devices may be necessary and may be provided. The arrangement of the measuring rolls 14 and 15 shown here by way of example is known in principle, but, in the known designs, the measuring rolls 14 and 15 are fixedly installed and the distance between them unalterable. The schematic representation in FIG. 1 indicates that, according to the invention, measuring rolls 14 and 15 are located in measuring roll stands 16 which have essentially the same dimensions, and above all the same support and reception surfaces, as the rolling stands 1 to 12. The measuring roll stands 16 are in additional reception pockets which are identical to the reception pockets of the rolling stand 1 to 12, with the exception of the roll drive which is absent. These reception pockets can be provided either additionally in the base frame of the rolling line or in the form of separate holders upstream of and beyond the base frame. The important point is that the measuring roll stands 16 also fit into the reception pockets for the rolling stands 1 to 12 and that they can be exchangeably clamped therein free from play.

Figure 2:
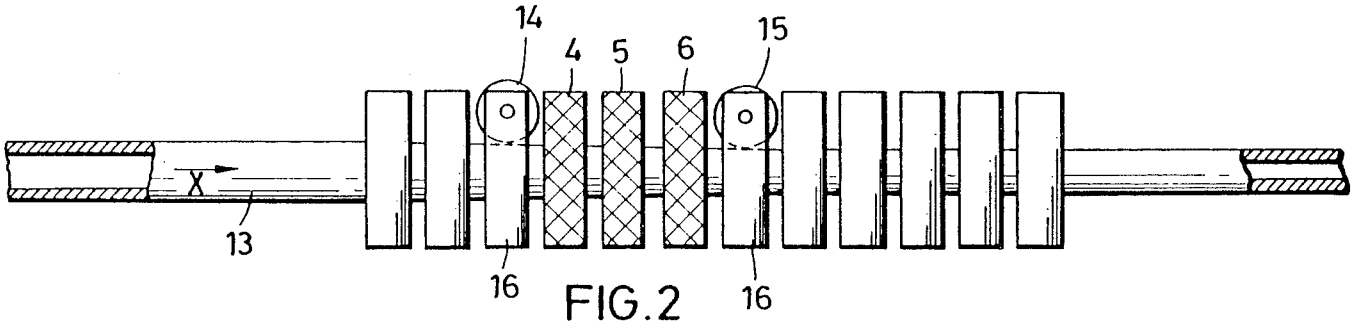
FIG. 2 is a rolling line of FIG. 1 with a smaller number of rolling stands.

FIG. 2 shows an operating situation in which only rolling stands 4, 5 and 6 are required because the desired tube is to have a larger outer diameter and a thicker wall. The reception pockets for the rolling stands 1, 2 and 8 to 12 thus remain empty, as is shown by the fact that they are not shaded in. Instead, the measuring roll stands 16 with the measuring rolls 14 and 15 are inserted and clamped into the reception pockets for the rolling stands 3 and 7, so that they are positioned, corresponding to FIG. 1, directly upstream of the first rolling stand 4 at the entry end and beyond the last rolling stand 6 at the delivery end. Thus a disadvantageously large distance between the measuring rolls 14 and 15 and the first or last working rolling stand 4 or 6 is not obtained. Irrespective of how many and which rolling stands 1 to 12 are used, the distance between the measuring rolls 14 and 15 and the first or last rolling stand respectively, and hence between one another, can be kept as small as possible. Furthermore, the distance between these measuring roll stands and hence between the measuring rolls or any other devices can always be precisely defined since the distances between the reception pockets which fix the measuring roll stands 16 and hence the measuring rolls 14 and 15 in the radial and axial directions are known. These distances can be input into the associated control device in order to ensure that the latter function correctly in any operating condition.

Figure 3:
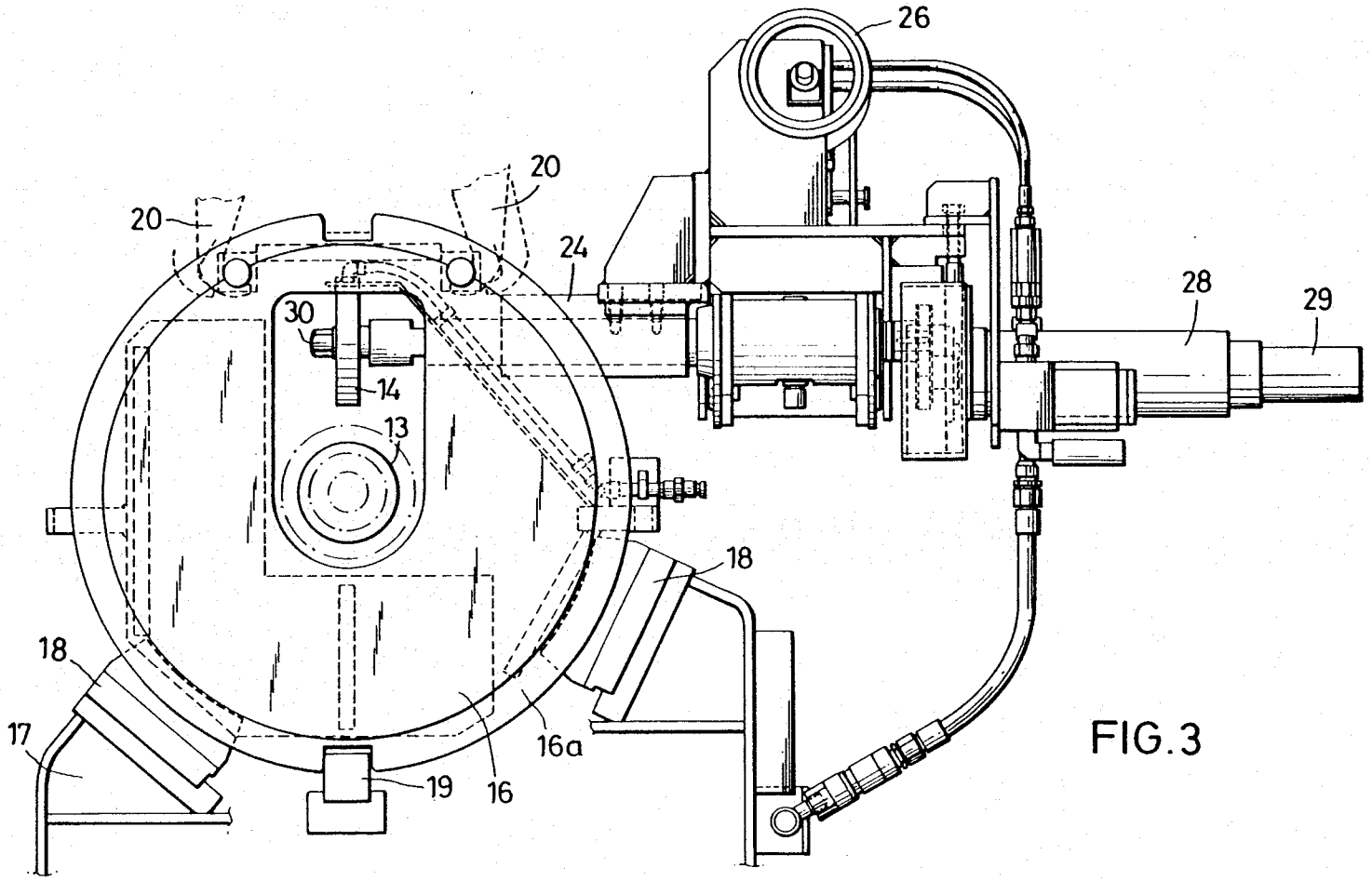
FIG. 3 is a front view of a measuring roll stand.
Figure 4:
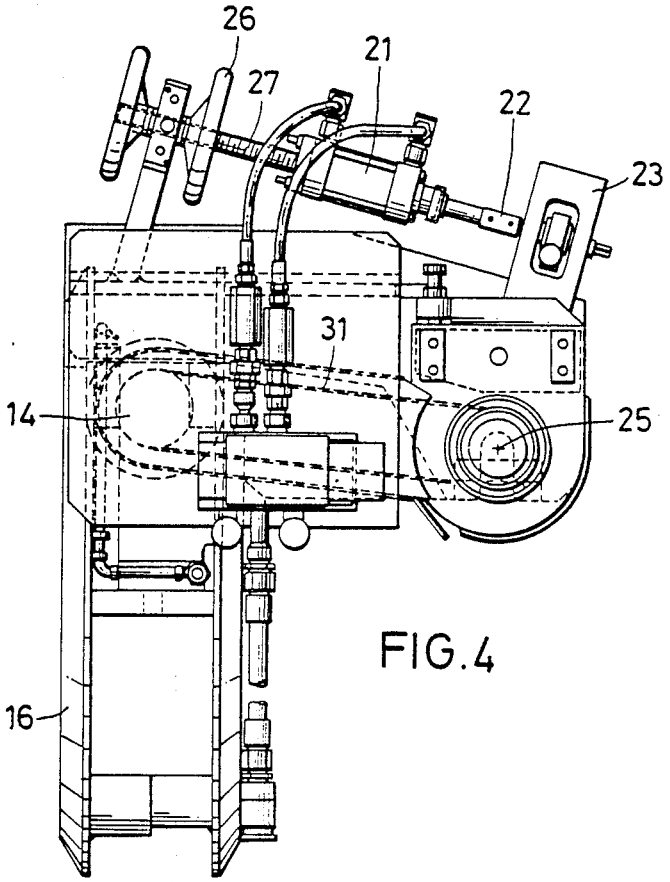
FIG. 4 is a side view of the measuring roll stand.
Figure 5:
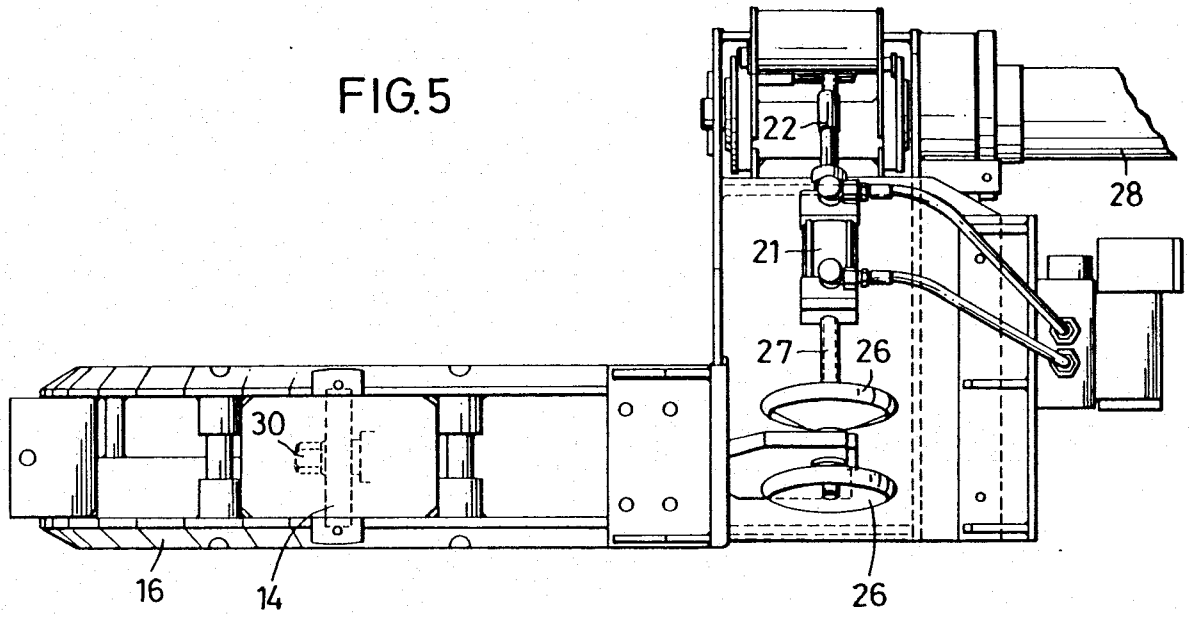
FIG. 5 is a plan view of the measuring roll stand.

The measuring roll stand 16 with the measuring roll 14 is shown in greater detail in FIGS. 3 to 5. FIG. 3 shows a base frame 17 and reception pockets 18 in the base frame 17. An adjusting piece 19 and support surfaces 16a of the measuring roll stand 16 as well as reception pockets 18 hold the rolling stand 16 in its correct position. The measuring roll stand 16 is fixed by a clamping device pressing from above but not shown in FIG. 3, which secures the measuring roll stand 16 both axially and radially. FIG. 3 shows hook-like conveying means 20 which are used to insert or remove the measuring roll stand 16 into or from the reception pockets 18.

The measuring roll 14 is shown in FIGS. 3 to 5 in its raised position, in which it does not touch the surface of the tube 13. FIGS. 4 and 5 show a working cylinder 21 which can be subjected to a pressure medium and which swings a bearing housing 24 (FIG. 3) for the measuring roll 14 about an axis 25 of rotation (FIG. 4) by way of a rod 22 and lever 23. In this way, the measuring roll can be lifted or pressed with a predetermined pressure onto the surface of the tube 13, the bearing pressure being controllable by the pressure medium acting in the cylinder 21. By raising the measuring roll 14 briefly, it is possible to avoid the leading end of a tube colliding on entry and damaging the measuring roll 14. In order to be able to set various tube diameters, hand wheels 26 are provided, using which a rod 27, and hence the position of the working cylinder 21, can be adjusted and secured. This acts by way of the working cylinder 21, the rod 22, the lever 23 and the bearing housing 24 in such a way that the position of the measuring roll is altered and adapted to the tube diameter.

The measuring roll is furthermore driven by a direct current motor 21 having a very smooth characteristic and having the object of compensating only for the torques and the friction of the measuring roll bearing and of a pulse generator 29 in order to prevent the measuring roll 14 slipping on the tube 13. The rotational speed of the measuring roll 14 is, however, not determined by the motor 28 but by the run-through speed of the tube 13. There is a rigid coupling between the motor 28 and the measuring roll 14 formed by the bearing shaft 30 of the measuring roll 14 and a toothed belt 31 (FIG. 4). The pulse generator 29 is also rigidly connected to the motor 28 so that the number of pulses generated per unit of time is indicative of the rotational speed of the measuring roll 14 and of the run-through speed of the tube 13.

In the foregoing specification we have set out certain preferred practices and embodiments of this invention, however, it will be understood that this invention may be otherwise embodied within the scope of the following claims.

We claim:

1. A rolling line for rolling tubular or rod-shaped material, having a plurality of rolling stands exchangeably clamped in reception pockets of a base frame closely one after the other, and having a measuring means disposed upstream of the rolling stands at the entry end and beyond the rolling stands at the delivery end and measuring a dimension or other characteristic of the material, each measuring means being supported in or on a measuring roll stand which has the same support and reception surfaces as the rolling stands and which can, like the rolling stands, be inserted and clamped in any reception pocket and like the rolling stands is fixed and immovable in its position thus, unlike the prior art the correct parting and correct attitude are thus resolved.

2. A rolling line as claimed in claim 1, in which an additional reception pocket for the measuring roll stands only is provided upstream of the first of the reception pockets suitable for rolling stands at the entry end and beyond the last of the reception pockets suitable for rolling stands at the delivery end.

3. A rolling line constructed and adapted to be operated substantially as described in claim 1 or 2 in which the rolling line is fitted with rolling stands in the middle of the rolling line for receiving the measuring means.

* * * * *